US006622001B2

(12) United States Patent
Arimitsu et al.

(10) Patent No.: US 6,622,001 B2
(45) Date of Patent: Sep. 16, 2003

(54) CLEANING UNIT WITH CONVEYING DEVICE

(75) Inventors: Takeshi Arimitsu, Kanagawa (JP); Susumu Nittani, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/976,100

(22) Filed: Oct. 15, 2001

(65) Prior Publication Data

US 2002/0048474 A1 Apr. 25, 2002

(30) Foreign Application Priority Data

Oct. 17, 2000 (JP) ..... 2000-317030

(51) Int. Cl.[7] ..... G03G 21/10
(52) U.S. Cl. ..... 399/358
(58) Field of Search ..... 399/350, 358, 399/360, 343, 353, 357

(56) References Cited

U.S. PATENT DOCUMENTS 4,685,798 A * 8/1987 Matsumoto ..... 399/358
5,260,750 A * 11/1993 Ishida et al. ..... 399/262

FOREIGN PATENT DOCUMENTS

JP 04287082 A * 10/1992 ..... G03G/21/00
JP 07325521 A * 12/1995 ..... G03G/21/10
JP 10301460 A * 11/1998 ..... G03G/21/10

* cited by examiner

*Primary Examiner*—Robert Beatty
(74) *Attorney, Agent, or Firm*—Fitzpatrick, Cella, Harper & Scinto

(57) ABSTRACT

A cleaning device includes a cleaning member, a cleaning container, a conveying unit, and a sliding fulcrum portion. The cleaning member removes developer from a member to be cleaned. The cleaning container contains therein the developer removed by the cleaning member. The cleaning container includes a developer containing portion, which is provided more remotely from the member to be cleaned than the cleaning member. The conveying unit conveys the developer removed by the cleaning member to the containing portion. The conveying unit includes a conveying member which conveys the developer and a rotatable crank shaft, which is provided more remotely from the member to be cleaned than the conveying member, and transmits a driving force to the conveying member. The sliding fulcrum portion slidingly supports the conveying member between a tip end portion of the conveying member and the crank shaft when the crank shaft is rotated.

12 Claims, 5 Drawing Sheets

CLEANING UNIT WITH CONVEYING DEVICE

BACKGROUND OF THE INVENTION

1. Field of the Invention

This invention relates to a cleaning device for removing a developer from a member to be cleaned such as an image bearing member, and this cleaning device is preferably used in an image forming apparatus using an electrophotographic process or the like, and to a process cartridge including the cleaning device.

2. Related Background Art

In an image forming apparatus such as a laser beam printer or a copier adopting the electrophotographic process, selective exposure is effected on an image bearing member uniformly charged by charging means to thereby form a latent image on the surface of the image bearing member. The latent image is then visualized as a developer image by a developer (toner) supplied from developing means, whereafter the developer image is transferred to a recording material, and further the developer image is fixed on the recording material by heat and pressure to thereby effect image recording.

Also, any developer residual on the image bearing member after the transfer of the developer image to the recording material is removed by a cleaning device provided in such an image forming apparatus, more particularly by a cleaning member such as a cleaning blade, and is collected into a cleaning container as residual developer (waste toner) and therefore, the next development can be effected without any developer being residual on the surface of the image bearing member.

Of those portions concerned in the above-described image formation, the image bearing member, the charging means, the developing means, and the cleaning member constructed integrally with one another and made into a cartridge detachably mountable to the main body of the image forming apparatus is put into practical use as a process cartridge, and in this case, the user himself carries out the interchange of the cartridge. Thus, expendables such as the image bearing member and the developer can be interchanged without the need for maintenance by a serviceman.

In the above-described cleaning means, the cleaning container has a capacity capable of containing therein the waste toner produced during the life of the image bearing member or until the toner contained in the developing means becomes exhausted. Also, in order to efficiently contain the waste toner, it has waste toner conveying means such as a rotary member provided in the vicinity of the image bearing member and the cleaning means.

An image forming apparatus including a process cartridge like the above-described example of the conventional art, in order to lengthen the life until the process cartridge is interchanged, has a tendency toward a larger capacity of the toner contained in the process cartridge and the resultant increase in the amount of waste toner and the balkiness of a waste toner containing portion.

Therefore, it is required to make the cleaning device compact and it is also required to make the developer conveying means in the cleaning device compact. Particularly, when rotary vanes are used as the developer conveying means, a space corresponding to the rotational locus of the rotary vanes becomes necessary, and it has been desired to utilize the space more effectively.

SUMMARY OF THE INVENTION

It is an object of the present invention to provide a compact cleaning device.

It is another object of the present invention to provide a cleaning device which enables a cleaning container to be made compact even if the amount of developer contained in the cleaning container is increased.

It is another object of the present invention to provide a cleaning device which enables the height of a cleaning container to be made small.

It is another object of the present invention to provide a cleaning device which enables the height of a space in which a developer conveying member is moved to be omitted.

Further objects and features of the present invention will become more apparent from the following detailed description when read with reference to the accompanying drawings.

DESCRIPTION OF THE PREFERRED EMBODIMENTS

The embodiments of the present invention will hereinafter be described with reference to the accompanying drawings.

In the following description, the widthwise direction of a process cartridge is a direction in which the process cartridge is detachably mounted with respect to the main body of an image forming apparatus, and coincides with the transporting direction of a recording material. Also, the lengthwise direction of the process cartridge is a direction intersecting with (substantially orthogonal to) the direction in which the process cartridge is detachably mounted to the main body of the image forming apparatus, and intersects with (is substantially orthogonal to) the transporting direction of the recording material. Further, the upper surface of the process cartridge is a surface lying above in a state in which the process cartridge has been mounted to the main body of the image forming apparatus, and the lower surface of the process cartridge is a surface lying below in the same state.

(First Embodiment)

A first embodiment of the present invention will first be described.

Figure 1:
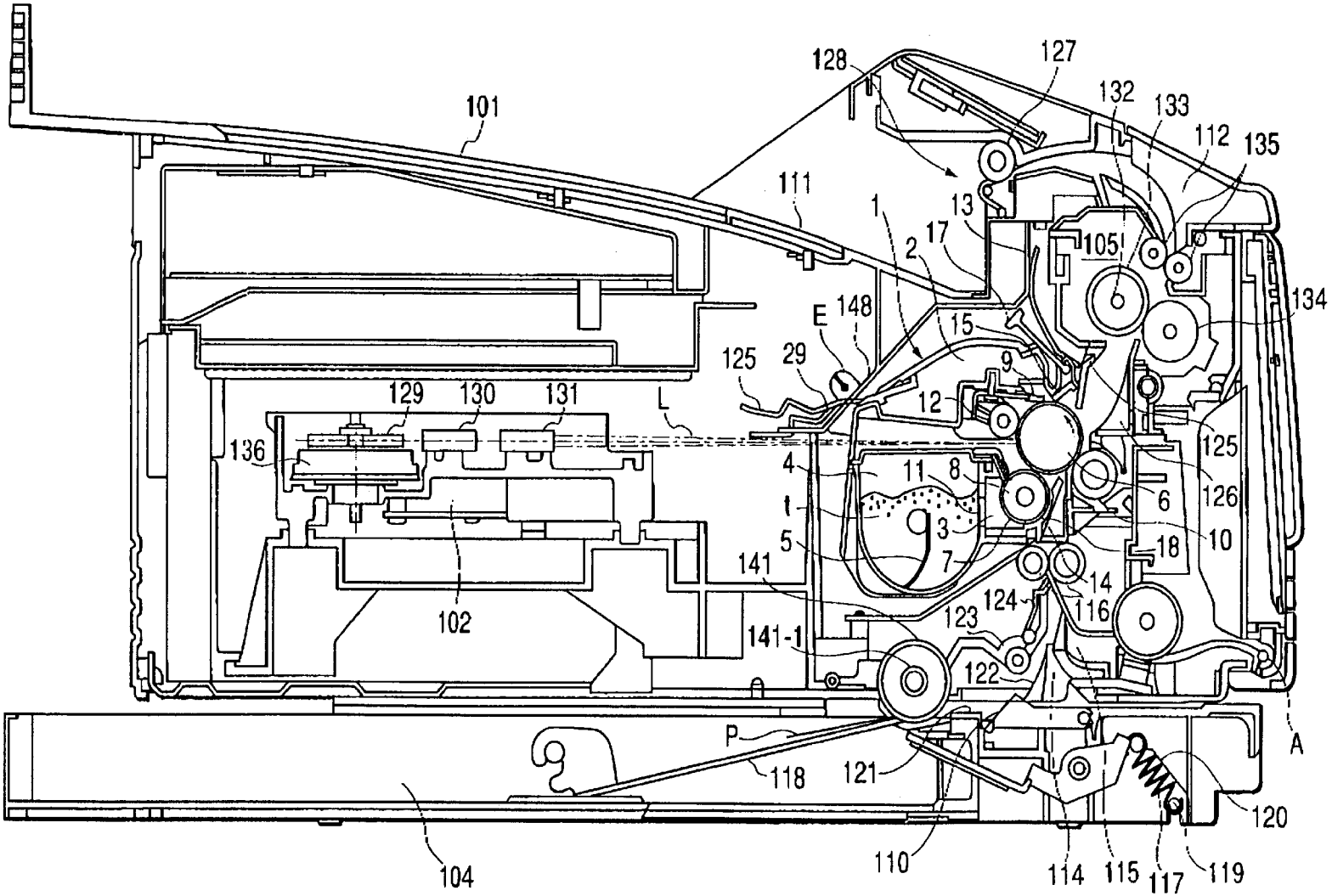
FIG. 1 is a cross-sectional view showing the construction of an image forming apparatus according to a first embodiment of the present invention.

FIG. 1 is a cross-sectional view showing the construction of a laser beam printer of the electrophotographic type which is an embodiment of the image forming apparatus according to the present invention.

A description will first be made of the construction of transporting means for a recording material.

A plurality of sheets of recording material P are stacked in a feed cassette 104, and the leading end portions of the sheets of recording material P are biased by a feed spring 117, and is urged against the surface of a feed roller 141 by a pivotally movable stack plate 118. When the user is to load the image forming apparatus with the recording material P, it can be realized by pulling out the feed cassette 104 rightwardly as viewed in FIG. 1. At this time, a feed spring supporting shaft 119 is moved upwardly in slide grooves 103 formed in the opposite side walls of the feed cassette 104 and therefore, the stack plate 118 is lowered to the bottom surface of the feed cassette 104, whereby the apparatus can be smoothly loaded with the recording material P.

The feed roller 141 is fixed to a feed driving shaft 141*a*, and a clutch and a solenoid (not shown) are provided on the end portion of the feed driving shaft 141*a*, whereby the control of the rotative driving of the feed roller 141 is possible. Separation claws 121 are provided in the right and left corners of the feed roller side leading end portion of the recording material P, and a cassette inlet guide 110 is provided in the vicinity of the tip ends thereof and is pivotally biased by a spring (not shown). Also, a recording material guide portion 122 is formed on an apparatus main body base 123 sideways of the feed cassette 104 so as to guide the recording material P to registration rollers 116. When the solenoid is energized by a feed starting signal, the driving force of a feed driving gear (not shown) is transmitted to the feed driving shaft 141*a* through a clutch (not shown), whereby the feed roller 141 is rotated and directs the recording material P to the cassette inlet guide 110. At this time, only the uppermost one of the sheets of recording material P is guided by the relation of the coefficient of friction thereof. Thereafter, the recording material P arrives at the nip portion between the registration rollers 116 by the rotation of the feed roller.

On the other hand, the apparatus main body base 123 is provided with second and third inlets 114 and 115 for directing recording materials P from other feed cassettes than the feed cassette 104 to the registration rollers 116. By such a construction, it becomes possible to install a plurality of decks and cassettes in the lower portion of the main body of the apparatus, and introduce recording materials from other feeding means, and this is a construction excellent in extensibility.

Also, a sensor lever 124 is provided upstream of the registration rollers 116. The sensor lever 124 is pivotally supported on the apparatus main body base 123, and detects the leading end portion of the recording material P by a photointerrupter or the like (not shown). When the leading end position of the recording material P is detected, the recording material P is transported to between a photosensitive drum 6 which is an image bearing member and a transfer roller 10 by the registration rollers 116 in register with the leading end of a toner image on the photosensitive drum 6.

Thereafter, the toner image formed on the photosensitive drum 6 by an image forming process which will be described later is transferred to the recording material P by the transfer roller 10 urged against the photosensitive drum 6 with predetermined pressure.

As auxiliary means when the recording material P is separated from the photosensitive drum 6, charge eliminating needles (not shown) are provided upstream of a fixing inlet guide 126, and even recording material P of a kind difficult to separate can be separated smoothly and the twining thereof around the photosensitive drum 6 can be prevented. Also, an inrush preventing guide 120 is disposed on the opposed surface of the fixing inlet guide 126, and even if bad separation of the recording material P occurs, serious jamming of the material P can be avoided.

The recording material P to which the toner image has been transferred is directed to fixing means 105 by the fixing inlet guide 126. The fixing means 105 has a fixing roller 133 having a heater 132 as a heat source therein, and a pressure roller 134 is urged against the fixing roller 133 under a predetermined pressure, and is rotatively driven by a driving gear (not shown). The detection of the temperature of the fixing roller 133 is effected by a thermistor (not shown) abutting against the surface of the fixing roller 133, and the fixing roller 133 is temperature-controlled by a controller in the power source of the main body 101 of the apparatus. Also, a non-contact thermoswitch (not shown) is disposed above the fixing roller 133 in order to prevent the more than necessary heating by the heater 132.

The recording material P passes through the nip portion between the heated fixing roller 133 and pressure roller 134, whereby the toner image is fixed on the recording material P. After the fixing, the recording material P is separated from the surface of the fixing roller 133 by a separation claw (not shown), and thereafter is transported upwardly by drawing rollers 135 disposed above the fixing roller 133. At this time, the drawing rollers 135 are rotatively driven at a relative speed higher by several percent than the speed of the fixing roller 133. Thus, the recording material P is transported while being forcibly drawn, and the occurrence of curl and wrinkles can be obviated. Thereafter, the recording material P is delivered out of the apparatus by a delivery roller 127, and is stacked on a delivery tray 111 provided at a delivery port 128. The above-mentioned transfer roller, fixing means, and drawing rollers are integrally fixed to a front cover 112. The front cover 112 is rotatably supported by the shaft A of the apparatus main body base 123, and is designed to be openable and closable relative to the main body 101 of the apparatus.

The construction of the laser optical system of the image forming portion will now be described.

A polygon mirror 129 which is a rotary polygon mirror is fixed onto the rotary shaft of a polygon motor 136 rotated at a high speed. A laser beam L emitted from a laser unit 109 passes through a collimator lens 137 and a cylindrical lens 138, and thereafter is reflected by the surface of the polygon mirror 129, and the laser beam is condensed on the photosensitive drum 6 through a spherical lens 130 and an fθ lens 131.

The laser beam L scans the photosensitive drum 6 in the generatrix direction thereof by the rotative driving of the polygon mirror 129 and also changes the irradiation point on the photosensitive drum 6 to predetermined potential by the ON-OFF drive of the laser unit 109. Thereby, an electrostatic latent image is formed on the photosensitive drum 6. In order to obtain the reference of the laser scanning (main scanning) of the photosensitive drum 6 in the generatrix direction thereof by the polygon mirror 129 at this time, a BD mirror 139 is provided at a location outside an image area which is the beginning of the main scanning direction. The laser beam L is reflected by the BD mirror 139, and thereafter is introduced into a laser beam receiving surface 142 provided at a location substantially equivalent to the photosensitive drum 6. Thereafter, the laser beam L is directed to a laser beam receiving element (not shown) on a DC controller (not shown) by an optical fiber 143 in the laser beam receiving surface 142. By detecting the beam by such a construction, the reference timing of laser scanning is obtained from image output timing. By a clock, an image signal is outputted to the laser unit from this reference timing, whereby the scanning in the main scanning direction is effected.

A scanner unit 102 having optical instruments such as the above-described polygon motor, mirror, and lenses is highly accurately positioned and fixed on the apparatus main body base 123.

The construction of the process cartridge 1 which is an image forming portion will now be described with reference to FIG. 2.

The process cartridge 1 of the present embodiment is divided into the photosensitive drum 6 which is a member to be cleaned (image bearing member), a charging roller 12 for effecting primary charging, a toner container 4 containing therein a toner t constituting developing means, a developing portion 3 for effecting development and further, a cleaning device 2 for collecting the toner remaining on the surface of the photosensitive drum 6 after transfer, and these image forming process instruments are made integral as a unit.

Also, the well-known electrophotographic process is used as an image forming method, and the construction of the process cartridge will hereinafter be described in accordance with the process.

A primary charging portion is disposed upstream of the exposure position of the laser beam L in the direction of rotation of the photosensitive drum 6. In the present embodiment, the charging roller 12 which is a semi-electrically conductive elastic member driven to rotate by the photosensitive drum 6 is in contact with the photosensitive drum 6 under a predetermined pressure to thereby constitute charging means. A bias is applied to the charging roller 12, whereby the surface of the photosensitive drum 6 can be uniformly charged.

Next, the toner t of the same polarity as that of primary charging is drawn up from the toner container 4 by an agitating member 5 and is fed into the developing portion 3 through an opening 11. The surface of a developing roller 7 is coated with a thin layer of toner t triboelectrically charged by the rubbing thereof against a developing blade 8. Further, a bias is applied to the developing roller 7, and an electrostatic latent image on the surface of the photosensitive drum 6 is visualized as a toner image by the toner t.

The toner image visualized on the photosensitive drum 6 is transferred to the recording material P by the bias of the transfer roller 10, as described above.

On the other hand, waste toner t still adheres to the surface of the photosensitive drum 6 as untransferred toner after the transfer.

A cleaning container 20 provided in the cleaning device 2 is provided with an opening portion 21 in a portion thereof opposed to the photosensitive drum 6. On the upstream side of the opening portion 21 in the direction of rotation (counter-clockwise direction) of the photosensitive drum 6, a dip sheet 15 (a polyethylene terephthalate sheet having a thickness of 30 $\mu$m–100 $\mu$m) is attached in a forward direction relative to the photosensitive drum 6 by the use of double-coated, adhesive tape or the like. Also, on the downstream side of the opening portion 21 in the direction of rotation (counter-clockwise direction) of the photosensitive drum 6, a cleaning blade 9 which is a cleaning member is provided and abuts against the photosensitive drum 6 in a counter direction. Thus, the above-mentioned waste toner t slips out through the dip sheet 15, is scraped off by the cleaning blade 9 and is stored in the cleaning container 20. The surface of the photosensitive drum 6 again becomes free of the toner t adhering thereto, and the next image forming process becomes possible.

Figure 2:
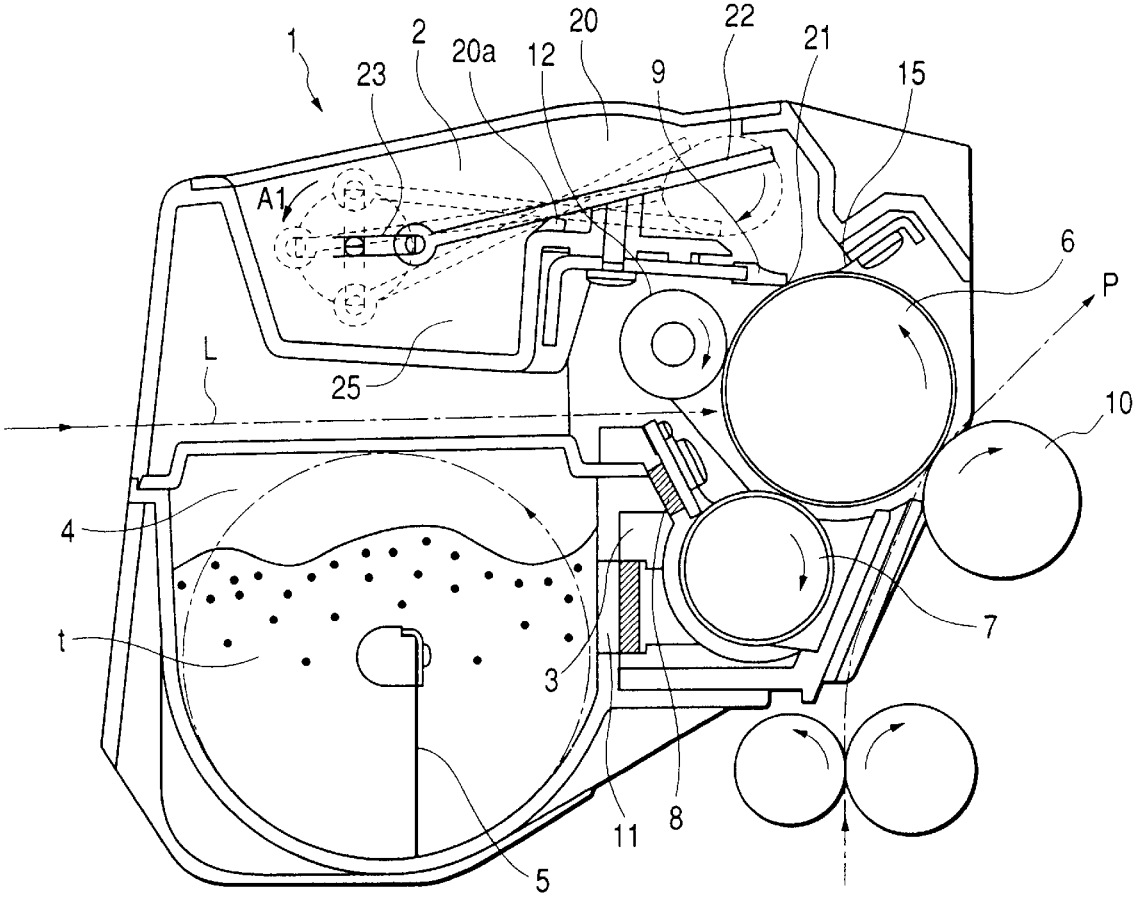
FIG. 2 is a cross-sectional view showing the construction of a process cartridge provided in the image forming apparatus of FIG. 1.
Figure 3:
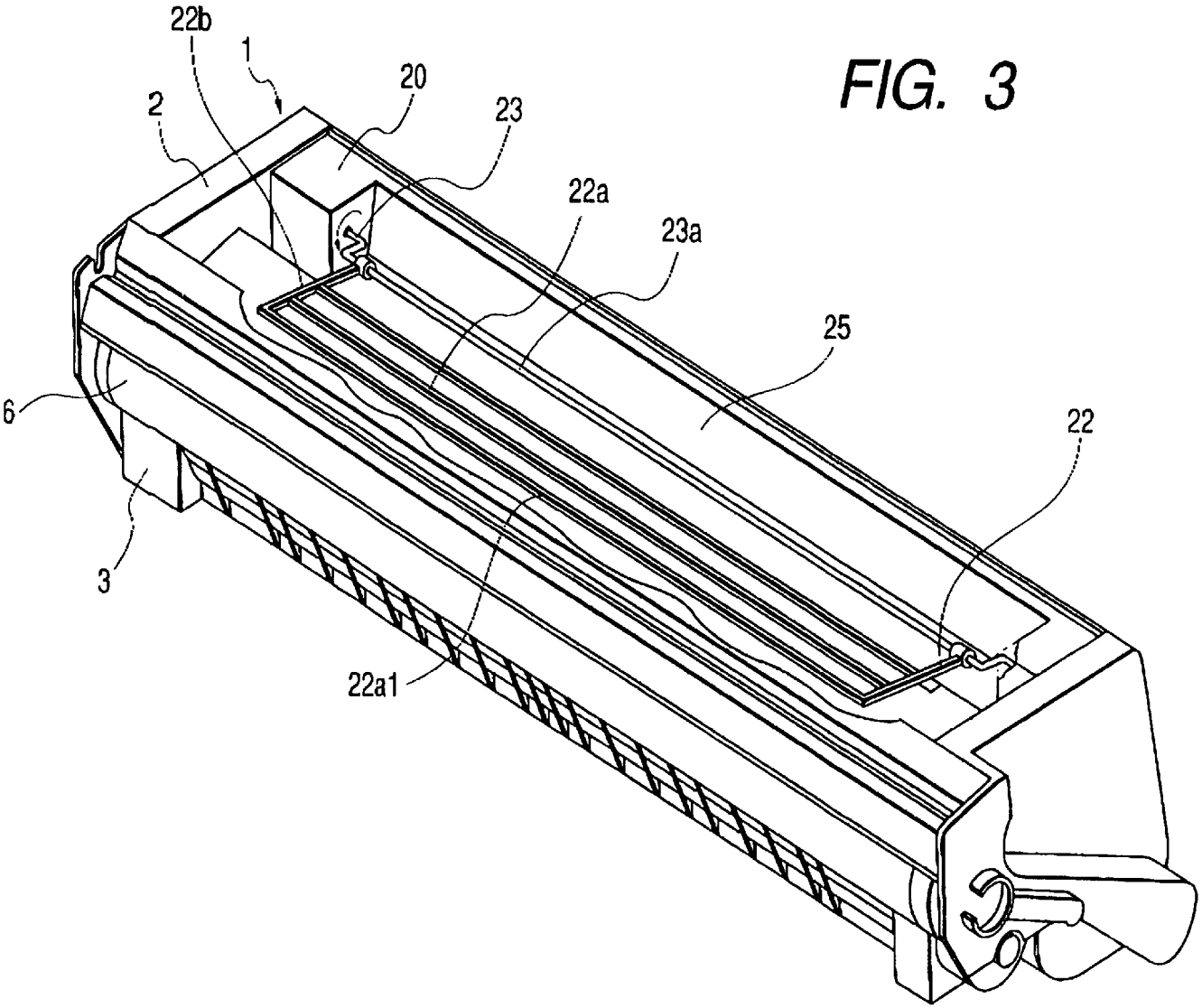
FIG. 3 is a partly broken away perspective view of the process cartridge of FIG. 2.

As shown in FIGS. 2 and 3, the disposition of each portion concerned in the cleaning of the photosensitive drum 6 is as follows.

The cleaning blade 9 abuts against the upper portion of the photosensitive drum 6, and the waste toner scraped off thereby is collected to the upper portion of the cleaning blade 9. Also, a waste toner containing portion 25 is provided at a position substantially horizontal to the cleaning blade 9 and above the toner container 4, and the waste toner collected to the upper portion of the cleaning blade 9 is sequentially contained therein.

In the cleaning container 20, there is provided a waste toner feeding member 22 which is a developer conveying member for conveying the waste toner from the upper portion of the cleaning blade 9 to the waste toner containing portion 25.

Also, a crank shaft 23 parallel with the drum shaft is pivotally provided in the waste toner containing portion 25.

The waste toner feeding member 22 comprises a toner feeding portion 22*a* and a supporting portion 22*b* which lie substantially on the same plane. As shown in FIG. 3, the toner feeding portion 22*a* comprises a plurality of bar-shaped members disposed in parallel to the drum shaft and at intervals in the cleaning container 20, and scrapes the toner t collected to the upper portion of the cleaning blade 9 toward the waste toner containing portion 25 side.

The supporting portion 22*b* comprises two bar-shaped members disposed at the opposite ends of the toner feeding portion 22*a*, and the widthwise one end thereof is fixed to a toner feeding portion 22*a*1 nearest to the photosensitive drum 6, and the widthwise other end thereof is pivotally supported on the crank portion 23*a* of the crank shaft 23.

Also, the supporting portion 22*b* is slidably supported by a waste toner feeding member supporting portion (sliding fulcrum portion) 20*a* provided integrally with the cleaning container 20. Thus, when the crank shaft 23 is rotated in a counter-clockwise direction indicated by the arrow A1 in FIG. 2 by driving means (not shown), the waste toner feeding member 22 substantially effects reciprocation.

At this time, the toner feeding portion 22*a* provided more adjacent to the photosensitive drum than the waste toner feeding member supporting portion 20*a* of the waste toner feeding member 22 effects reciprocation approximate to clockwise rotation. Thus, when the toner t is scraped out from the upper portion of the cleaning blade 9 to the waste toner containing portion 25, the toner feeding portion 22*a* passes the lower surface side, and when the toner t moves from the waste toner containing portion 25 side to the upper portion side of the cleaning blade 9, the toner feeding portion 22*a* passes the upper surface side. The toner feeding portion 22*a* provided in a plurality performs a similar operation, whereby the toner t is sequentially scraped out from the upper portion side of the cleaning blade 9 and is contained in the waste toner containing portion 25. When the crank shaft 23 is thus rotated, the toner feeding member 22 does not move up and down at the position of the supporting portion 20*a* and further, the upward and downward movement of the tip end portion of the toner feeding member does not become so great. Accordingly, the vertical space of the cleaning container 20 can be saved.

(Second Embodiment)

A second embodiment of the present invention will now be described. In the second embodiment, portions similar in construction to those in the first embodiment are given the same reference characters and need not be described.

In the present embodiment, other aspects of the first embodiment will be described as the developer conveying member for conveying the waste toner from the upper portion of the cleaning blade 9 to the waste toner containing portion 25, with reference to FIG. 4.

As in the above-described first embodiment, a crank shaft 23 parallel with the axis of the photosensitive drum 6 is pivotally provided in the waste toner containing portion 25. In the cleaning container 20, there are disposed a plurality of waste toner feeding members 24 for conveying the waste toner from the upper portion of the cleaning blade 9 to the waste toner containing portion 25.

The waste toner feeding members 24 comprise toner feeding portions 24*a* and supporting portions 24*b* which lie substantially on the same plane. The supporting portions 24*b* are bar-shaped members extending in the widthwise direction, and are in the lengthwisely opposite end portions in the cleaning container 20, and one end thereof is pivotally supported on the crank shaft 23 and the other end is constructed integrally with the toner feeding portions 24*a* which are bar-shaped members horizontal to the drum shaft.

Also, the supporting members 24*b* are slidably supported by a waste toner feeding member supporting portion 20*a* provided integrally with the cleaning container 20.

Figure 4:
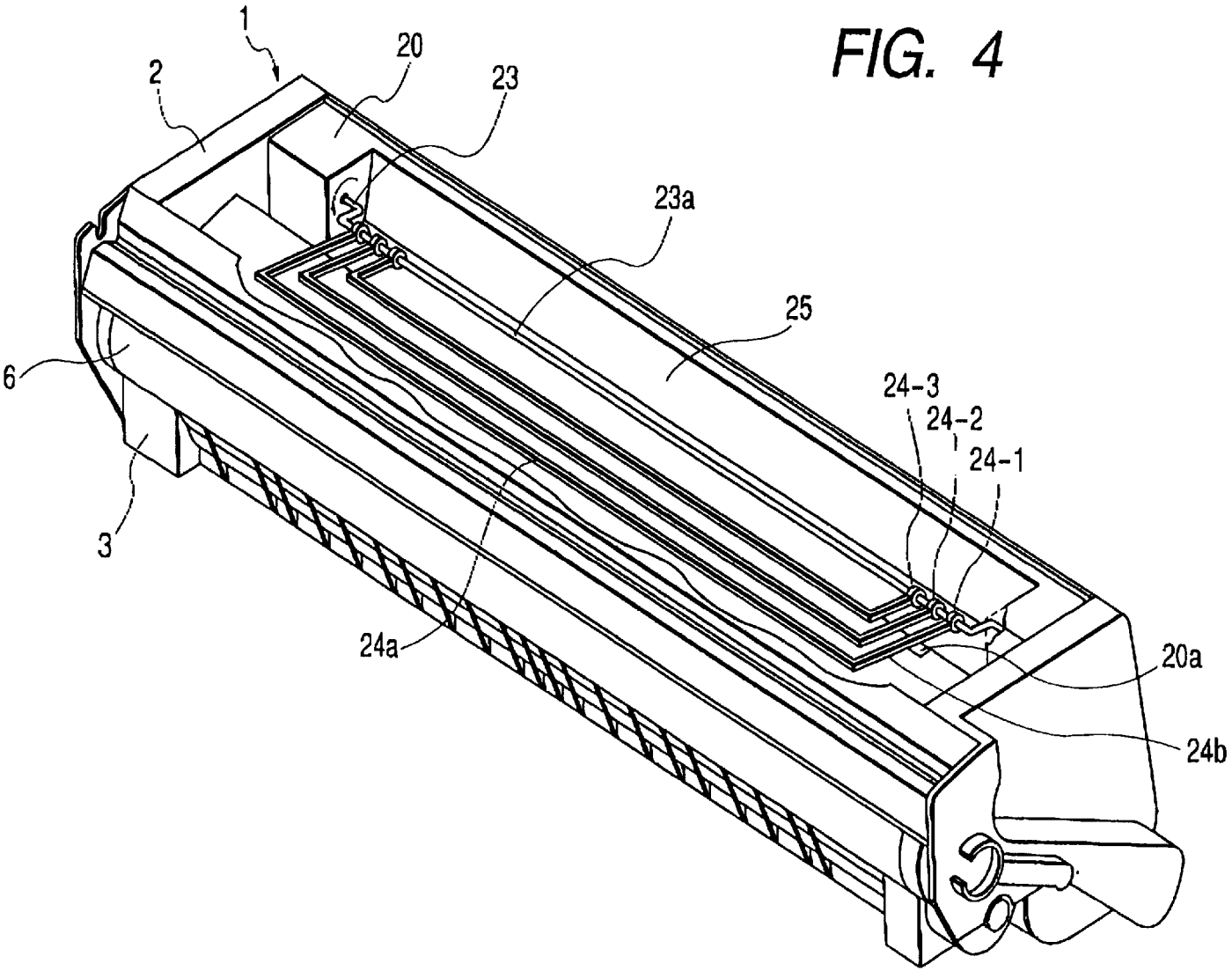
FIG. 4 is a partly broken away perspective view of a process cartridge in a second embodiment of the present invention.

When the crank shaft 23 is clockwisely rotated as shown in FIG. 4 by driving means (not shown), respective waste toner feeding members 24-1, 24-2, 24-3, . . . substantially effect reciprocation in operative association therewith.

At this time, the toner feeding portions 24*a* provided more adjacent to the photosensitive drum 6 than the supporting portions 24*b* of the waste toner feeding members 24 effect reciprocation approximate to counter-clockwise rotation, as shown in FIG. 4.

Thus, when the toner t is scraped out from the upper portion of the cleaning blade 9 to the waste toner containing portion 25, the toner feeding portions 24*a* pass the lower surface side, and when the toner t moves from the waste toner containing portion 25 side to the upper portion side of the cleaning blade 9, the toner feeding portions 24*a* pass the upper surface side.

Figure 5:
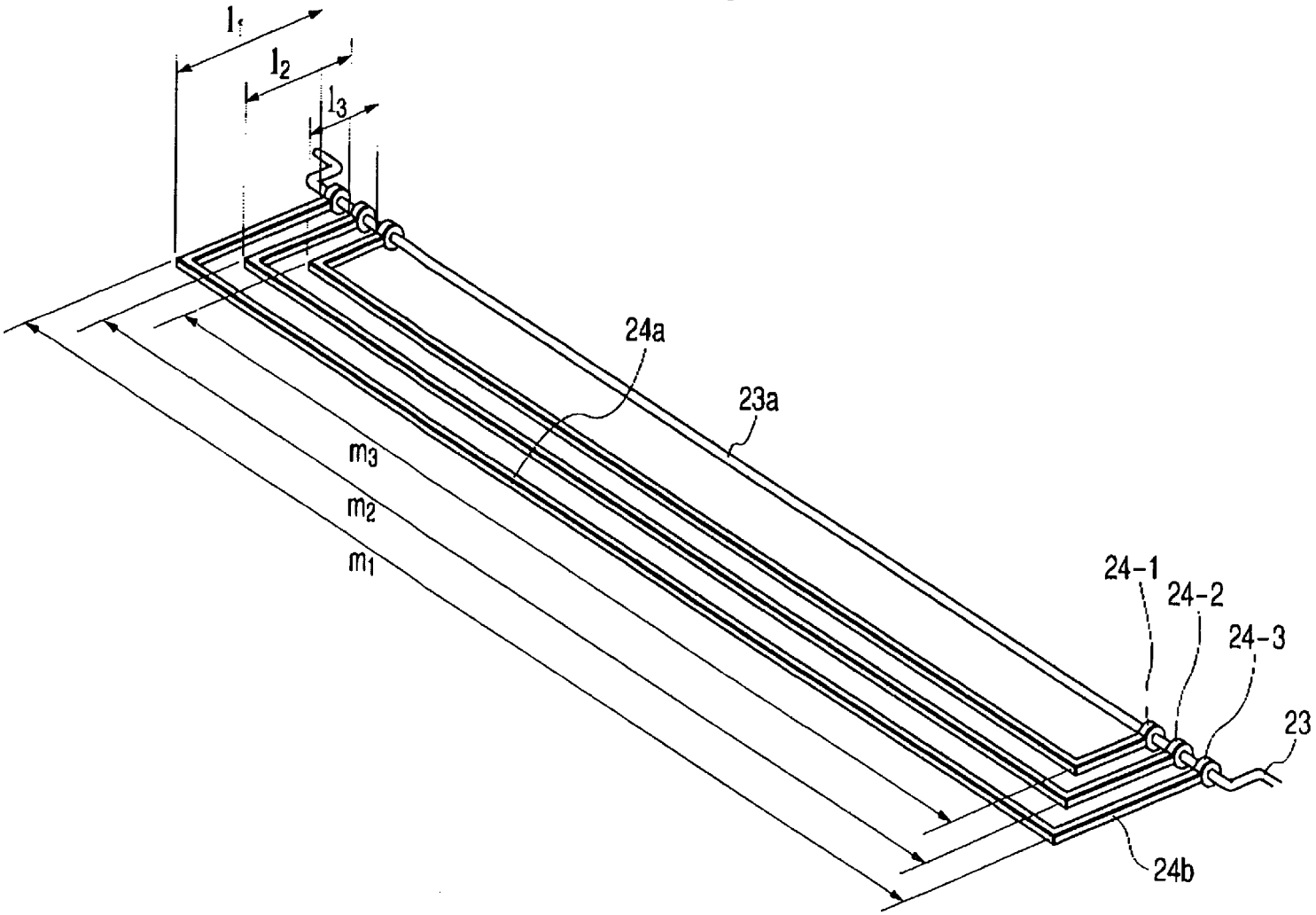
FIG. 5 is a cross-sectional view showing an embodiment of the process cartridge of FIG. 4.

When as shown in FIG. 5, the lengths of the supporting portions of the waste toner feeding members 24-1, 24-2, 24-3, . . . are defined as $l_1$, $l_2$, $l_3$, . . . , respectively, and the lengths of the toner conveying portions thereof are defined as $m_1$, $m_2$, $m_3$, . . . , respectively, $l_1$,>$l_2$,>$l_3$ . . . , and $m_1$>$m_2$>$m_3$ . . . . The waste toner scraped out from the upper portion of the cleaning blade 9 by the waste toner feeding member 24-1 is fed within the range in which the waste toner feeding members 24-2 and 24-3 having the toner feeding portions on the waste toner containing portion 25 side effect reciprocation, whereby it is conveyed toward the waste toner containing portion 25.

Thus, even if the crank shaft is rotated, the toner feeding members 24 do not move up and down at the positions of the supporting portions 20*a* and the upward and downward movement of the tip end portions of the toner feeding members 24 is limited to a small level.

As described above, according to the present invention, the developer conveying member conveys the developer removed from the image bearing member by the cleaning member toward the waste toner containing portion formed in the cleaning container on the remote side relative to the cleaning member and therefore, the degree of freedom of the design of the shape of the cleaning container heightens, and even if the amount of developer to be contained in the cleaning container is increased by the lengthened life of the process cartridge, a compact cleaning device and a compact process cartridge can be realized.

The present invention is not restricted to the above-described embodiments, but all modifications are possible within the scope of the technical idea of the present invention.

What is claimed is:

1. A cleaning device comprising:

a cleaning member for removing a developer from a member to be cleaned;

a cleaning container for containing therein said developer removed by said cleaning member;

said cleaning container includes a developer containing portion, which is provided more remotely from said member to be cleaned than said cleaning member;

conveying means for conveying said developer removed by said cleaning member to said containing portion, wherein said conveying means includes a conveying member for conveying said developer and a rotatable crank shaft, which is provided more remotely from said member to be cleaned than said conveying member for transmitting a driving force to said conveying member; and a sliding fulcrum portion supporting said conveying member between a tip end portion of said conveying member and said crank shaft, said sliding fulcrum portion slidably supporting said conveying member when said crank shaft is rotated.

2. A cleaning device according to claim 1, wherein said sliding fulcrum portion is provided in said cleaning container.

3. A cleaning device according to claim 1, wherein a length of said cleaning container in a direction in which said developer is conveyed by said conveying member is greater than a height of said cleaning container.

4. A cleaning device according to claim 1, wherein when said crank shaft is rotated, said conveying member substantially effects reciprocation.

5. A cleaning device according to claim 1, wherein said conveying member includes a bar-shaped portion.

6. A cleaning device according to claim 1, wherein said conveying member includes a pair of bar-shaped portions extending in a direction perpendicular to an axial direction of said crank shaft at opposite end portions of said crank shaft, and a bar-shaped portion linking said pair of bar-shaped portions together and extending in the axial direction of said crank shaft.

7. A cleaning device according to claim 6, wherein said bar-shaped portion extending in the axial direction of said crank shaft is provided in a plurality.

8. A cleaning device according to claim 6, further comprising a sliding fulcrum portion sliding with said conveying member when said crank shaft is rotated, and wherein said pair of bar-shaped portions slide with said sliding fulcrum portion.

9. A cleaning device according to claim 1, wherein said member to be cleaned is an image bearing member for bearing an image thereon.

10. A cleaning device according to claim 9, wherein an axial direction of said crank shaft is a same as an axial direction of said image bearing member.

11. A cleaning device according to claim 9, wherein said cleaning device together with said image bearing member are provided in a process cartridge, which is detachably mountable to a main body of an image forming apparatus.

12. A cleaning device comprising:

a cleaning member for removing a developer from an image bearing member;

a cleaning container for containing therein said developer removed by said cleaning member, said cleaning container being provided with a developer containing portion provided more remotely from said image bearing member than said cleaning member;

conveying means for conveying said developer removed by said cleaning member to said containing portion, wherein said conveying means includes a conveying member for conveying said developer and a rotatable crank shaft, which is provided more remotely from said image bearing member than said conveying member for transmitting a driving force to said conveying member; and a sliding fulcrum portion supporting said conveying member between a tip end portion of said conveying member and said crank shaft, said sliding fulcrum portion slidably supporting said conveying member when said crank shaft is rotated.

* * * * *

UNITED STATES PATENT AND TRADEMARK OFFICE

CERTIFICATE OF CORRECTION

PATENT NO. : 6,622,001 B2
DATED : September 16, 2003
INVENTOR(S) : Takeshi Arimitsu et al.

It is certified that error appears in the above-identified patent and that said Letters Patent is hereby corrected as shown below:

Title page,
Item [56], References Cited, FOREIGN PATENT DOCUMENTS,
"04287082" should read -- 04-2870852 --;
"07325521" should read -- 07-325521 --; and
"10301460" should read -- 10-301460 --.

Signed and Sealed this

Ninth Day of March, 2004

JON W. DUDAS
*Acting Director of the United States Patent and Trademark Office*